United States Patent [19]

Shahinpoor

[11] Patent Number: 5,038,532

[45] Date of Patent: Aug. 13, 1991

[54] DEPLOYABLE SPATIAL STRUCTURE

[75] Inventor: Mohsen Shahinpoor, Albuquerque, N. Mex.

[73] Assignee: University of New Mexico, Albuquerque, N. Mex.

[21] Appl. No.: 419,306

[22] Filed: Oct. 10, 1989

[51] Int. Cl.[5] ..... E04H 12/18

[52] U.S. Cl. ..... 52/109; 52/646

[58] Field of Search ..... 52/646, 109

[56] References Cited

U.S. PATENT DOCUMENTS

| | | | |
|---|---|---|---|
| 226,101 | 3/1880 | Pfautz . | |
| 446,560 | 2/1891 | Osborn . | |
| 736,671 | 8/1903 | Aksila . | |
| 3,496,687 | 2/1970 | Greenberg | 52/646 |
| 3,672,104 | 6/1972 | Luckey | 52/646 |
| 3,868,961 | 4/1975 | Harris . | |
| 3,877,544 | 3/1975 | Sternis . | |
| 4,013,114 | 3/1977 | Goebel | 52/109 |
| 4,475,323 | 10/1984 | Schwartzberg | 52/646 |
| 4,557,083 | 12/1985 | Zanardo | 52/109 |
| 4,942,700 | 7/1990 | Hoberman | 52/109 |

FOREIGN PATENT DOCUMENTS

| | | | |
|---|---|---|---|
| 1419013 | 10/1965 | France | 52/109 |
| 795523 | 10/1978 | U.S.S.R. | 135/25.2 |

*Primary Examiner*—Henry E. Raduazo

*Attorney, Agent, or Firm*—Albert Sopp

[57] ABSTRACT

The present invention relates to a deployable, continuously extendible and collapsible, closed or open ended, free standing or supported spatial structure comprising an array of spaced apart adjacent layers or tiers of pivotally connected criss-crossed bars with the bars in each layer being connected to each other in rows and columns and with rods coupling the layers together.

17 Claims, 8 Drawing Sheets

DEPLOYABLE SPATIAL STRUCTURE

FIELD OF THE INVENTION

The present invention relates in general to deployable, expandible and contractible spatial structures of the type having a plurality of scissors-like elements, and more particularly to an expandible and contractible open or closed spatial structural array comprising multilayers or tiers of criss-crossed structural bars pivotally connected to each other to form rows and columns thereof in each tier or layer and cross connected from layer to layer by rods.

BACKGROUND OF THE INVENTION

There are many devices and structures in the prior art of the type having a plurality of scissors-like elements tandemly connected at pivot points to provide a deployable spatial structure. One such structure is shown in U.S. Pat. No. 736,671 which provides a mono-planar extendible and retractible lazy tongs fruit picker. In U.S. Pat. No. 226,101 there is shown an extension tower having four sets of lazy tongs pivotally connected at right angles to each other to form a tower essentially rectangular in transverse cross section when the tongs are extended by virtue of a worm driven screw.

U.S. Pat. No. 3,868,961 shows two parallel lazy tongs connected at end pivot points by transverse rods which support a canvas awning. U.S. Pat. No. 446,560 discloses an aerial ladder comprising two parallel sets of lazy tongs cross connected by bars at all of their pivot points. U.S. Pat. No. 3,877,544 shows a stress balanced extendible boom comprising parallel rows of lazy tongs cross connected by rods in various ways and having torsion bars to prevent the boom from twisting or becoming unstable.

SUMMARY OF THE INVENTION

The present invention relates to a deployable, continuously extendible and collapsible, closed or open ended, free standing or supported spatial structure comprising an array of spaced apart adjacent layers or tiers of pivotally connected criss-crossed bars with the bars in each layer being connected to each other in rows and columns and with rods coupling the layers together.

An object of the present invention is to provide a spatial structure having a multiplicity of different uses in the fields of buildings, bridges, furniture, supports, and other spatial structures as well as in the fields of toys and amusement.

Another object of the invention is to provide a spatial structure adaptable to different forms, uses, and purposes at the option of the user.

Another object of the invention is to provide a closed or circular expandible, contractible spatial structure of infinitesimally variable radius or circumference adaptable for use in motive systems such as belt drives or pulleys or transmission systems.

Yet another object of the invention is to provide a wheel, friction gear, transmission, pulley, or other rotatable or rollable body of infinitely variable perimeter.

Another object of the invention is to provide a collapsible, flexible spatial structure which may adapted for rectilinear or curvilinear orientation such as a structural and/or decorative wall or ceiling in a building structure or toy.

Another object of the invention is to provide a flexible, collapsible, expandible, adjustable support or spatial structure as an item of furniture or decoration or toy.

Yet another object of the invention is to provide a spatial structure or frame to support or comprise a wall or ceiling or floor which may be permanent or movable, e.g., props for stage productions.

Another object of the invention is to provide a spatial structure of low volume when collapsed and expandable to contain or occupy relatively large volumes and thus advantageous for use in zero gravity or underwater applications.

BRIEF DESCRIPTION OF THE DRAWINGS

Reference is now made to the accompanying drawings in which like numerals represent like parts and in which.

DESCRIPTION OF THE PREFERRED EMBODIMENTS

Figure 1:
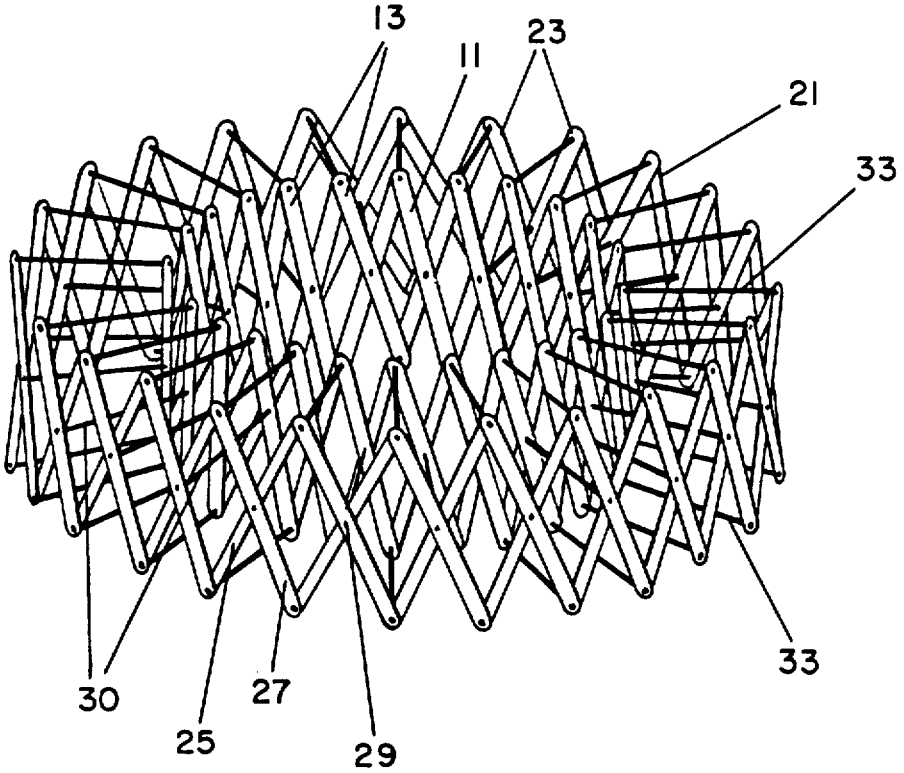
FIG. 1 is a view of a closed spatial structure in accordance with an embodiment of the invention in its compressed or retracted state.
Figure 2:
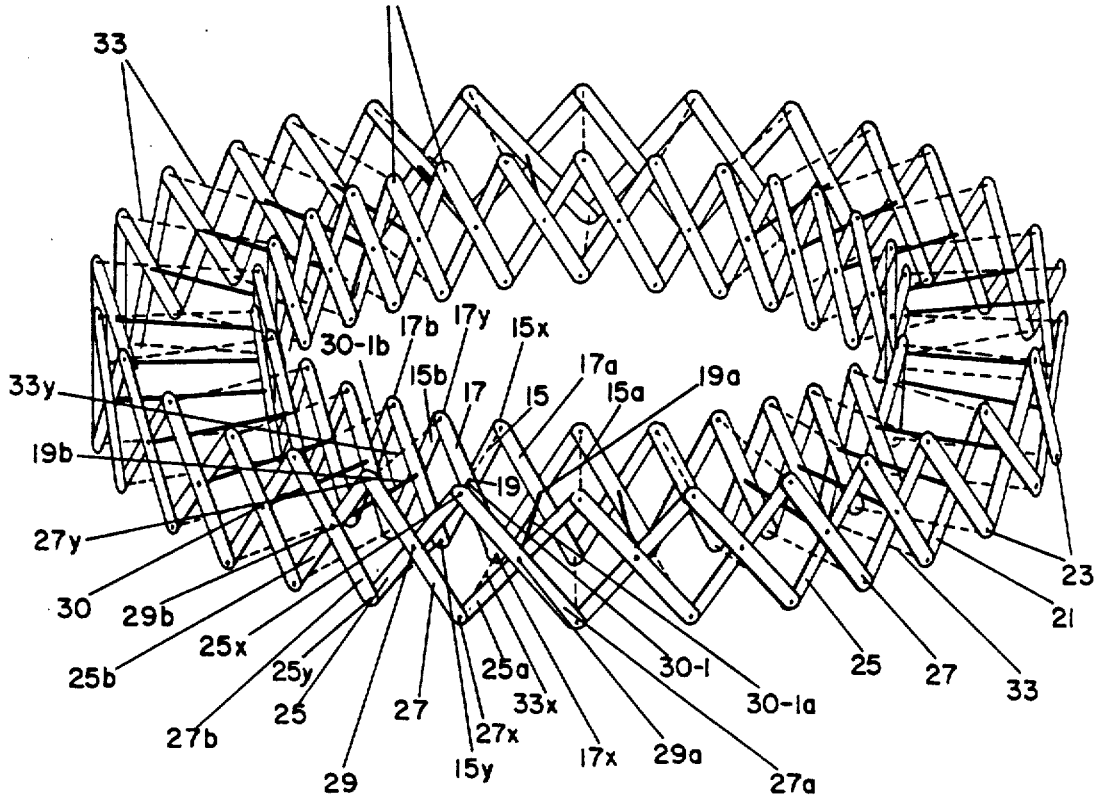
FIG. 2 is a view of the closed spatial structure of FIG. 1 in an expanded state.

Referring to FIGS. 1 and 2 which show a closed or endless (e.g., polygonal, circular, or cylindrical) spatial structure in accordance with the invention, there is provided a generally cylindrical inner body 11 comprising a plurality of tandemly connected expandible and contractible elements 13 arranged in a circle. Each of the elements 13 comprises a pair of criss-crossed bars 15 and 17 pivotally connected to each other at their common center point 19. Each of said bars may be semi-rigid or flexible, and in any event are composed of any suitable well known material so that each bar is capable of twisting slightly about its longitudinal axis and bending slightly about its transverse axis. The larger the radius of the structure, the less degree of bending needed for the bars.

The ends of each of the bars 15 and 17 are also pivotally connected to the ends of the bars of adjacent elements. These are shown in FIGS. 1 and 2 for purposes of illustration as adjacent elements 13*a* and 13*b* having respective criss-crossed bars 15*a*, 17*a*, and 15*b*, 17*b* with corresponding center points 19*a* and 19*b*. As a matter of convention, the bars numbered 15, 15*a*, and 15*b* are slanted or oriented in similar direction as are the bars numbered 17, 17*a*, 17*b*.

The end portion of the bar 15 that is pivotally connected to adjacent bar 17*a* is designated as 15*x*, and the end portion of bar 17 that is pivotally connected to adjacent bar 15*a*is designated as 17*x*. Likewise, the end portion of bar 15 that is connected to bar 17*b* is designated 15*y*, and the end portion of bar 17 that is pivotally connected to bar 15*b* is designated 17*y*.

The spatial structure of the embodiment shown in FIGS. 1 and 2 further comprises an outer body 21 which, when contracted or expanded, is of distinctly greater circumference than body 11 when it is likewise contracted or expanded. Outer body 21 has a plurality of tandemly connected expandible and contractible elements 23 in juxtaposition or correspondence with elements 13 of inner body 11.

More particularly, the expandible and contractible elements 23 of the outer body 21 are in approximate registry with and thus correspond to the previously described elements 13 of the inner body. As mentioned earlier, for purposes of description, reference is being made to just three adjacent ones of the elements 13 of the inner body—those having criss-crossed bars 15 and 17, 15*a* and 17*a*, and 15*b* and 17*b*. Likewise, in describing an illustrative portion of the outer body which corresponds to those inner body elements, there are elements 23 which comprise criss-crossed semi-rigid or flexible bars 25 and 27, 25*a* and 27*a*, and 25*b* and 27*b* having respective intersecting pivot points at 29, 29*a*, and 29*b*. The bars 25, 27, 25*a*, 27*a*, 25*b*, and 27*b* of the outer members 23 have similar or slightly greater flexing and twisting capabilities in comparison with the bars 15, etc.

Further, in the same manner as was described in the case for the end portions of the adjacent bars in the inner elements 13, the corresponding end portions of the adjacent sets of criss-crossed bars in the outer elements 23 are pivotally connected as follows: one end of bar 25 at pivot point 25*x* to an end of bar 27*a*; the other end of bar 25 at pivot 25*y* to an end of bar 27*b*; one end of bar 27 at pivot 27*x* to an end of bar 25*a*; the other end of bar 27 at pivot 27*y* to an end of bar 25*a*.

As shown in FIGS. 1 and 2, at least some of the pivot points of elements 13 of the inner body 11 are connected by semi-rigid or flexible, essentially central radial rods 30 to corresponding pivot points of elements 23 of the outer body 21. The central, radially extending rods 30 lie essentially in the plane of the transverse axes of the array 11.

More particularly, in accordance with an embodiment of the invention, pivot points of the criss-crossed bars 15 and 17, 15*a* and 17*a*, and 15*b* and 17*b* of the inner body 11 are connected by the central, radially extending rods 30 to the pivot points of criss-crossed pairs 25 and 17, 25*a* and 27*a*, and 25*b* and 27*b* of the outer body 21 as follows: a central radial rod 30-1 connects center pivot 19 of bar pair 15, 17 of the inner body to center pivot 29 of bar pair 25, 27 of the outer body; central radial rod 30-1*a* connects center pivot 19*a* of bar pair 15*a*, 17*a* of the inner body to center pivot 29*a* of bar pair 25*a*, 27*a* of the outer body, and central radial rod 30-1*b* connects center pivot 19*b* of bar pair 15*b*, 17*b* of the inner body to center pivot 29*b* of bar pair 25*b*, 27*b*, of the outer body, and so on, for all of the corresponding criss-crossed bars of the juxtaposed inner and outer elements 13 and 23.

That is, as shown in FIGS. 1 and 2, each of the center points of the inner and outer criss-crossed pairs of bars 15, 17, and 25, 27, etc. is connected by a central radial rod 30. However, it is not essential or required that all or even most of the center points of the inner body be connected to corresponding center points of the outer body. As a practical minimum, only three of such center pivots of the inner and outer bodies need be connected by central, radially extending rods if the rods are essentially equally spaced apart, e.g., about 120 degrees apart. Only two such rods are necessary so long as maintenance or integrity of ae generally circular shape of the spatial structure is of no great importance. Also, it is not required that the end points of said rods be pivotally connected to the bars or to the pivot points of the bars. That is, in accordance with an embodiment of this invention, the central rods 30 need not be connected to pivot points of the bars and need not be capable of rotation with respect to the bars. However, as already discussed in accordance with an embodiment of the invention, the ends of the rods 30 may conveniently serve as the pivots or hinges for the bars.

Further structural support may be provided for the spatial structure as a whole by employing additional rods connecting some or all of the end portions of the bars of the inner members 13 with corresponding end portions of the outer members 23. According to the invention, the inner elements 13 may be further connected to the outer elements 23 by means of outer, generally radially oriented rods 33 disposed on either side of the central radial rods 30—i.e., either side of the plane of the transverse axes of the array. The connections of the rods 33 as shown in FIGS. 1 and 2 are as follows: Rod 33*x* connects end portion pivot 17*x* of bar 17 of the inner body 13 to end portion pivot 27*x* of bar 27 of the outer body 23, and rod 33*y* connects end portion pivot 17*y* of bar 17 of the inner body 13 to end portion pivot 27*y* of bar 27 of the outer body 23.

According to this embodiment there need not be provided similar outer rod connections for the end portions of alternate bars 17*a* and 17*b* of the inner body 11 and corresponding bars 27*a* and 27*b* of the outer body 21. Also, there need not be any rod connections for the end portions of the bars 15, 15*a*, and 15*b*, etc., of the inner body and for the end portions of bars 25, 25*a*, and 25*b*, etc. of the outer body. Thus, as shown in accordance with this embodiment, the end portions of only one bar in every other criss-crossed pair of bars in the inner and outer bodies 11 and 21 are connected by an outer rod 33. Of course, in accordance with the principles of the invention all or none of the end portions can be connected by rods if desired.

According to an example in accordance with one embodiment of the invention, bars and rods of the following material and dimensions are as follows: For each of the bars 15, 17, 25, 27, etc., a plastic or wooden bar (about the same size and flexibility as a medical swab stick) about 6 inches long, ¾ of an inch wide, and about 1/16th of an inch thick; for each of the rods 30, 33, plastic or wooden dowels about 6 inches long with diameter of about 3/16ths of an inch.

Also, it should be appreciated that when the inner body 11 is in its fully contracted position, the outer body 21 is of course not fully contracted. That is, when the inner body 11 is contracted, all of its adjacent bars, e.g., 15*a*, 15, 15*b* and 17*a*, 17, and 17*b* are in close or intimate contact with each other. However, in the outer body 21, the corresponding criss-crossed bars 25*a*, 25, and 25*b* and 27*a*, 27, and 27*b* are expanded apart from each other, the extent of expansion, i.e., the value of Cos $O_2$, being approximately proportional to the number of criss-crossed members, $n_2$, in the outer body 21.

Further, it is understood that the length, width, or thickness of each of the bars 15, etc. of elements 13 of the inner body need not be the same as the length, width, or thickness of the bars 25, etc. of the elements 23 of the outer body 21. For example, if the bars 25, etc. of the elements 23 of the outer body 21 are each about twice as long as the bars 15, etc. of the elements 13 of the inner body 11, when the inner body 11 is fully contracted, the outer rods 33 will be splayed outwards from the transverse axes of the array—the plane formed by the central radial rods 30—the angle of the splay being approximately proportional to the ratio of length of a bar 25, etc. to the length of a bar 15, etc. Also, the larger the ratio of the length a bar 25, etc. of outer elements 23 to the length of a bar 15, etc., of the inner elements 13, the less is the degree of expansion of the outer body 21 when the inner body 11 is fully contracted.

Still referring to FIG. 2, the extent of expandability of the spatial structure is related to the dimensional relationships of the various elements of the structure as follows. If the respective diameters of the inner and outer bodies 13 and 23 are denoted by $D_1$ and $D_2$, then:

$$\pi D_1 = n_1 l_1 \cos \theta_1 \quad (1)$$

$$\pi D_2 = n_1 l_2 \cos \theta_2 \quad (2)$$

$$D_1 + 2S = D_2 ( \quad (3)$$

where $\theta_1$ and $\theta_2$ are the angles of each inner and outer criss-crossed bar respectively to the plane of the transverse axes, $n_1$ and $n_2$ respectively are the numbers of criss-crossed members in the inner and outer bodies, $l_1$ and $l_2$ respectively are the lengths of each bar in the inner and outer bodies, and S is the spacing or radial distance between the inner and outer bodies 13 and 23—i.e., the length of one of the central rods 30. For example, the outer diameter $D_2$ can easily be determined from equations (1), (2), and (3) as follows:

$$D_2 = (n_1 l_1/\pi)\cos \theta_1 + 2S \quad (4)$$

Similarly, the length of an outer bar can be determined thusly:

$$l_2 = \pi(D_1 + 2S)/n_2 \cos \theta_2 \quad (5)$$

Of course, it should be readily understood that $\theta_1$ may range in value from zero degrees to near ninety degrees in a continuous fashion and that $n_1$, $n_2$, $l_1$, $l_2$, and S may be varied.

To minimize bending stress on the outer rods 33, the joints, if of the hinge type, preferably should not be too tight, i.e., of too close tolerance. Instead of hinge type joints, joints having three axes of rotation such as ball and socket joints of any suitable well known construction may be used. Such joints virtually eliminate bending stress on the outer rods 33.

Figure 3:
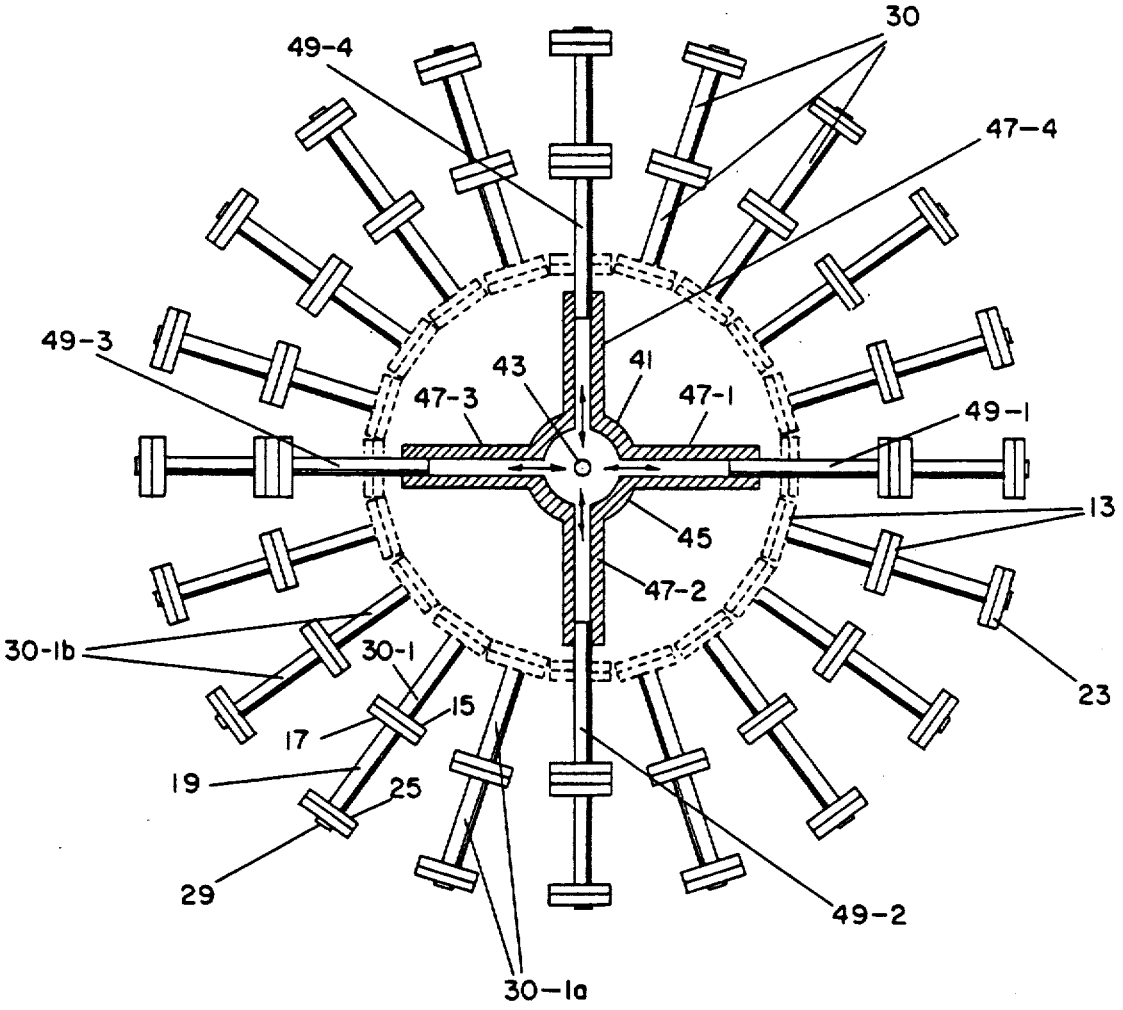
FIG. 3 depicts in modified transverse cross section the structure of FIGS. 1 and 2 in contracted [broken line] and expanded [solid line] positions in combination with actuator means in accordance with an embodiment of the invention.

Reference is now made to FIG. 3 which shows in modified transverse cross section the closed spatial structure of FIGS. 1 and 2 in retracted (broken line) and extended (solid line) positions, and means to move the structure to those positions in an infinitely variable manner.

More particularly, as shown in FIG. 3 there is provided a hydraulic or pneumatic actuator mechanism 41 having an axial fluid feed conduit 43 located within a central housing 45. The housing 45 has cylinders 47-1, 47-2, 47-3, and 47-4 extending radially therefrom at cardinal points. The cylinders 47-1, etc. are fluidly coupled to each other and to feed conduit 43 and have respective actuator pistons 49-1, 49-2, 49-3, and 49-4 movable inwardly and outwardly in each of their cylinders. That is, the pistons 49-1, etc. move inwardly or outwardly in unison in accordance with the fluid pressure in the conduit 43.

As indicated in FIG. 3, when the pistons 49-1, etc. are in their retracted positions, the inner criss-crossed elements 13 are in the positions shown by the broken lines. When the pistons 49-1, etc. are extended, the inner elements 13 are in the solid line positions as shown, and the outer elements 23 are in the extended position as shown by the solid lines. It should be noted that the inner positions of the outer elements 23 would be congruent with the outer positions of the inner elements 13 as shown in FIG. 3 because the extent of the travel of the pistons 49-1, etc. as shown in this embodiment is about the same as the length of the rods 30 and 33. This is indicated by the lead lines from the reference numeral 13 in FIG. 3. Of course, this dimensional relationship need not be the case.

Figure 4:
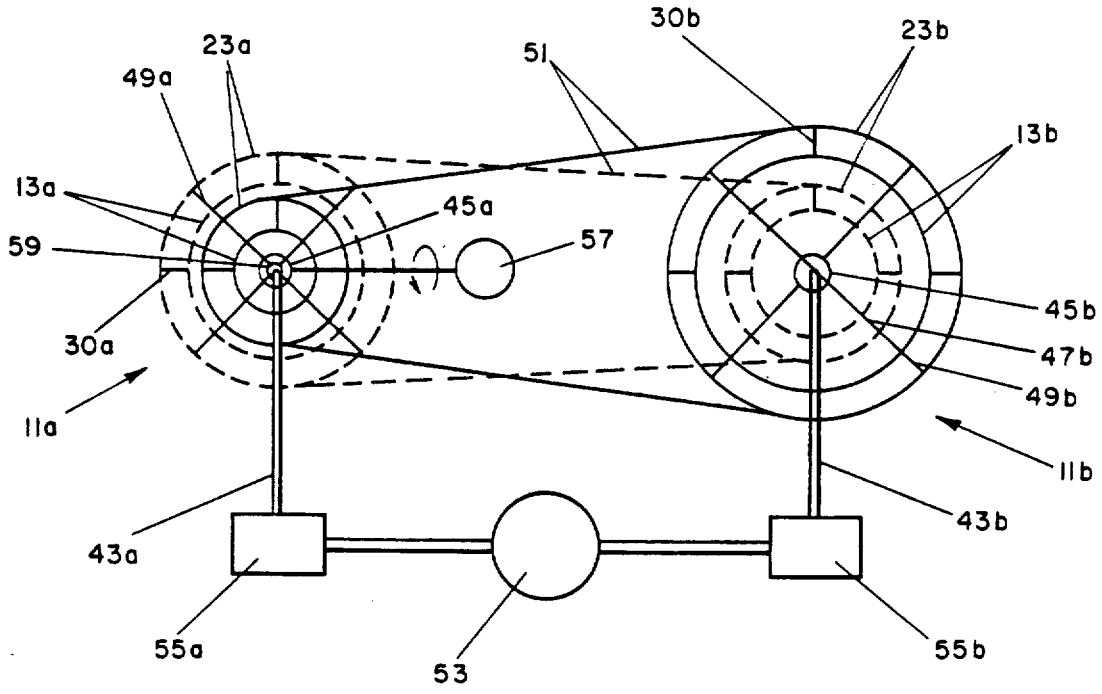
FIG. 4 shows in diagram form two of the spatial structures as in FIGS. 1 and 2 oriented in combination to provide pulley or transmission system having infinitely variable mechanical advantage in accordance with an embodiment of the invention.

Referring to FIG. 4, there is shown a diagram of a pulley system comprising two rotatably mounted closed spatial structures 11*a* and 11*b* having respective inner elements 13*a* and 13*b* and outer elements 23*a* and 23*b* movable from contracted to expanded positions. Structure 11*a* is shown in its contracted position (solid line) and has an expanded position (shown in broken lines) while structure 11*b* is shown in its expanded position (solid lines) and has a contracted position (shown in broken lines). The structures 11*a* and 11*b* are coupled by a web 51 of essentially constant length.

In the same manner as explained in connection with FIG. 3, the rotating structure 11*a* has a fluid conduit 43*a* which supplies fluid via housing 45*a* to each of four cylinders 47*a* to actuate pistons 49*a*. Similarly, structure 11*b* has a fluid conduit 43*b* which supplies fluid via housing 45*b* to cylinders 47*b* to actuate pistons 49*b*. A source for the fluid is indicated by the numeral 53, and may be any suitable well known pressurized canister or combination reservoir/pump unit for supplying fluid in the form of either a gas a liquid under pressure. A first control unit 55*a* couples the fluid from source 53 to the conduit 43*a*, and a second control unit 55*b* couples the fluid from the source to the conduit 43*b*. An electric motor or any other suitable well known source of motive power indicated by the numeral 57 provides power via a gear or pulley 59 to the axis of the unit 11*a* to rotate the pulley system.

The control units 55*a* and 55*b* may take a number of forms well known in the art of fluid control systems and may, for example, comprise electromagnetically actuatable valves controlled by analog or digital electrical signals so that, as the valves in unit 55*a* are adjusted to increase the fluid pressure in conduit 43*a* to thereby cause the pistons 49*a* to move radially outward to move elements 13*a* and 23*a* to radially expanded positions thus increasing the circumference of 11*a*, the valves in unit 55*b* are reciprocally adjusted to decrease the fluid pressure in conduit 43*b* so that the pistons 49*b* are retracted, thereby decreasing the radius of structure 11*b*. This may be done manually or via a reciprocally related valve control system or by any other suitable well known means.

It should be readily appreciated that the extent of expansion and contraction of the two spatial structures 11*a* and 11*b* of the pulley system shown in FIG. 3A is, within the limits of maximum expansion and contraction of each of said units, infinitely variable. This is highly advantageous in motive power systems in a number of ways, including the provision of continuously variable rotational speed and/or mechanical advantage. Thus, for example, if the unit 11*a* is rotated by motive power source 57 at a constant speed, the unit 11*b* may be controlled via controllers 55*a* and 55*b* to vary the speed of unit 11*b* by infinitesimally variable amounts. As further examples, this mechanism be applied to vehicles such as automobiles or bicycles where, with the drive shaft or pedal rotation rate kept constant, the vehicle speed may be varied by varying the radius of the drive wheels.

Figure 5:
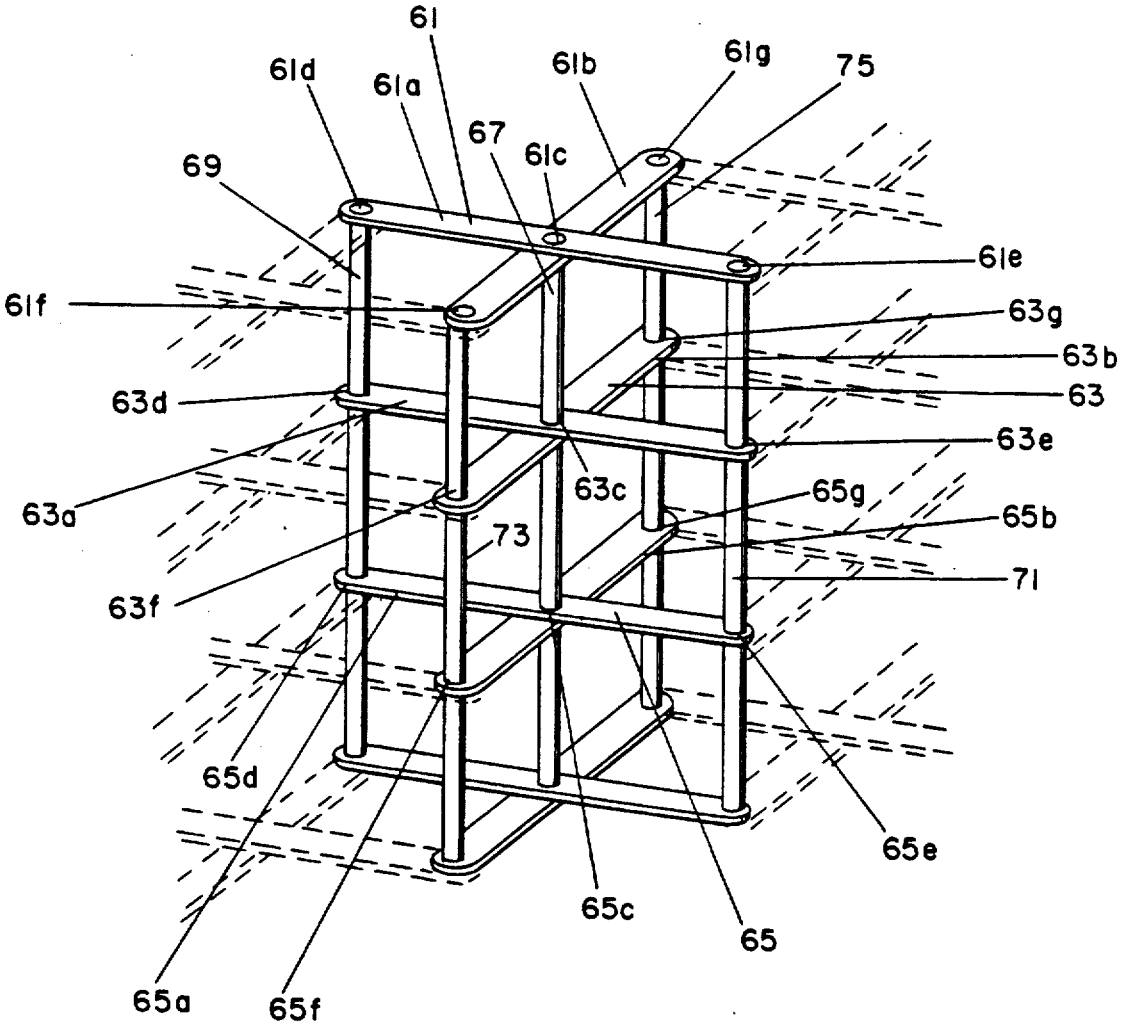
FIG. 5 shows a modified view in perspective of an element of an open end body in accordance with an embodiment of the invention.
Figure 6:
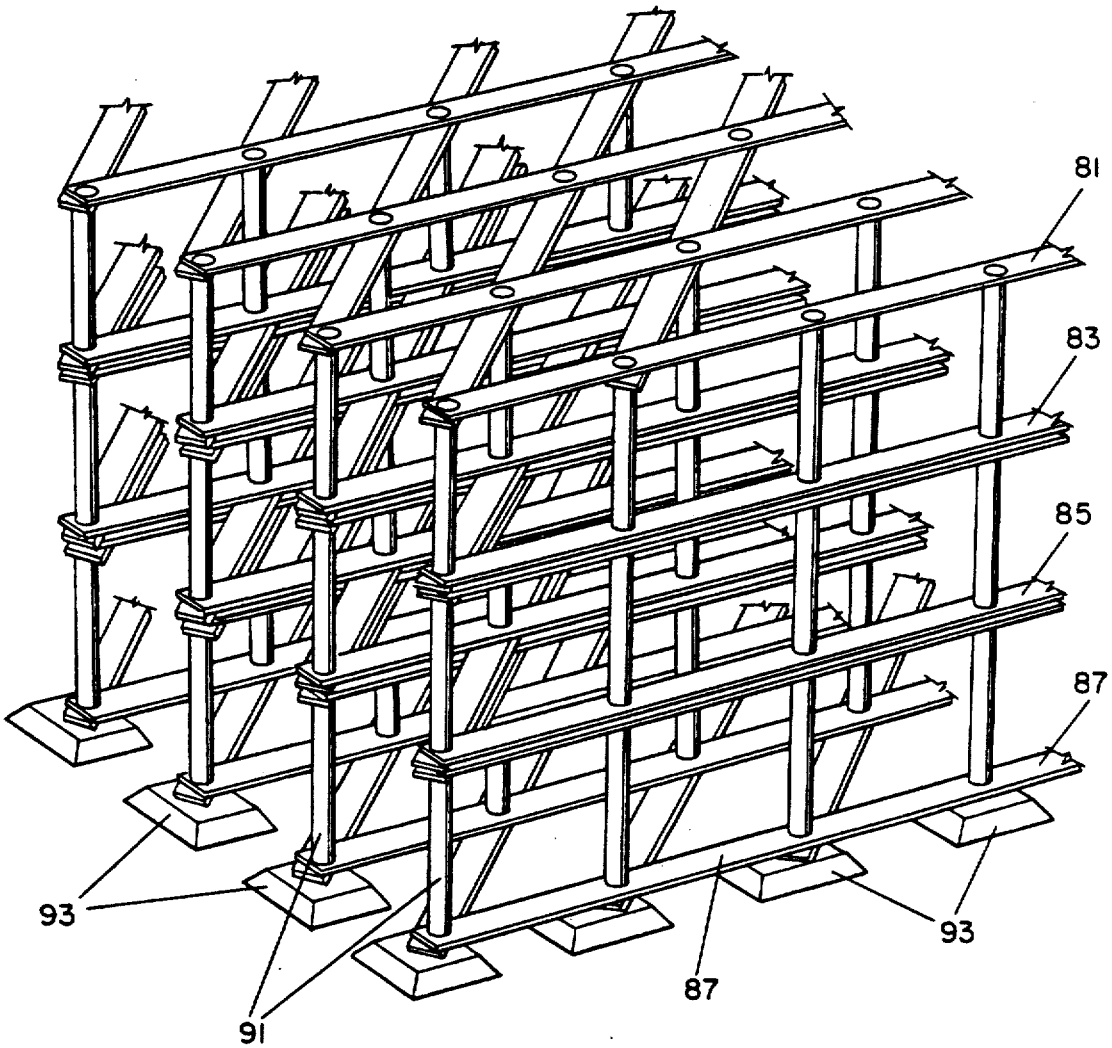
FIG. 6 is a view of an open ended multilayer spatial structure in accordance with an embodiment of the invention shown in a partially extended position.

Reference is now made to FIG. 5 which shows an element or building block of an open ended body in accordance with an embodiment of the invention, and to FIG. 6 which shows a multilayer, multi-tiered structure in accordance with another embodiment of the invention, and to FIG. 7 which depicts an arched or curved wall spatial structure constructed in accordance with an embodiment of the invention, The structural element or building block shown in FIG. 5 includes a multiplicity of spaced apart, generally parallel sets of criss crossed bars, the first set 61 comprising criss crossed bars 61*a* and 61*b* crossing at central opening 61*c*, the second set 63 comprising criss crossed bars 63*a* and 63*b* crossing each other at central opening 63*c*, and the third set 65 comprising criss crossed bars 65*a* and 65*b* crossing each other at central opening 65*c*. The bars may be rigid, semi-rigid, or flexible. A rod 67 passes through the openings 61*c*, 63*c*, and 65*c* at the intersection of each of the sets of bars and is hingeably connected to said bars thereat by any suitable well known means.

Each of the bars also has an opening at or near both of its end portions, the bar 61*a* having openings 61*d*, 61*e*; the bar 61*b* having openings 61*f*, 61*g*; the bar 63*a* having openings 63*d*, 63*e*; the bar 63*b* having openings 63*f*, 63*g*; the bar 65*a* having openings 65*d*, 65*e*; the bar 65*b* having openings 65*f*, 65*g*.

In the same manner as described for the central rod 67, an outer rod 69 passes through openings 61*d*, 63*d*, and 65*d* and is hingeably connected thereat to each of the bars 61*a*, 63*a*, and 65*a*. In like manner, a rod 71 passes through openings 61*e*, 63*e*, 65*e*; a rod 73 passes through openings 61*f*, 63*f*, 65*f*, and a rod 75 passes through openings 61*g*, 63*g*, 65*g*, all of said rods being hingeably connected to the respective bars at said openings.

As shown by the broken lines in FIG. 5 the rods 67, 69, 71, and 73 may be extended indefinitely, and the bars 61*a*, 61*b*, 63*a*, 63*b*, 65*a*, 65*b* may be hingeably connected at their end portion openings to further bars so that, in effect, several sets of bars are interconnected to comprise an large body of many building blocks or elements. Such bodies are shown in FIGS. 6 and 7. Also, as indicated by the line B—B, a building block may comprise an element composed of half of the structure shown in FIG. 5, i.e., a unit composed of bars 63*a*, 63*b*, and 65*a*, 65*b*, and portions of the rods 69, 71, 73, and 75 connected thereto.

Referring to FIG. 6, there is shown a large, generally rectangular spatial structure including one and a half tiers, three columns, and eight rows of the building blocks or elements described in FIG. 5. The structure is shown in a partially extended position and has a top layer of criss crossed bars 81, two intermediate layers of criss crossed bars 83 and 85, and a bottom or base layer of such bars, 87. The bars all have openings near their opposite ends and at their cross-over points through which an array of vertical rods 91 extend. Each rod is hingeably connected to each bar in each layer by any suitable well known hinge arrangement. The bottom layer 87 may be affixed to a series of sited base plates or foundation elements 93. All of the bars and rods in the structure may be rigid so that, when the bottom layer is anchored to the base plates 93, the entire structure becomes set in place and essentially monolithic.

It should be appreciated that a structure arranged in accordance with the embodiment shown in FIG. 6 may serve as a bridge, edifice, item of furniture, decorative item, or structural toy. It should also be appreciated that where the bars and rods are fabricated of slippery and/or resilient material such as plastic, the rods and bars may be joined together at their hinge points by a slotted or press fitting. Such an arrangement is shown in FIGS. 7A and 7B.

Figure 7A:
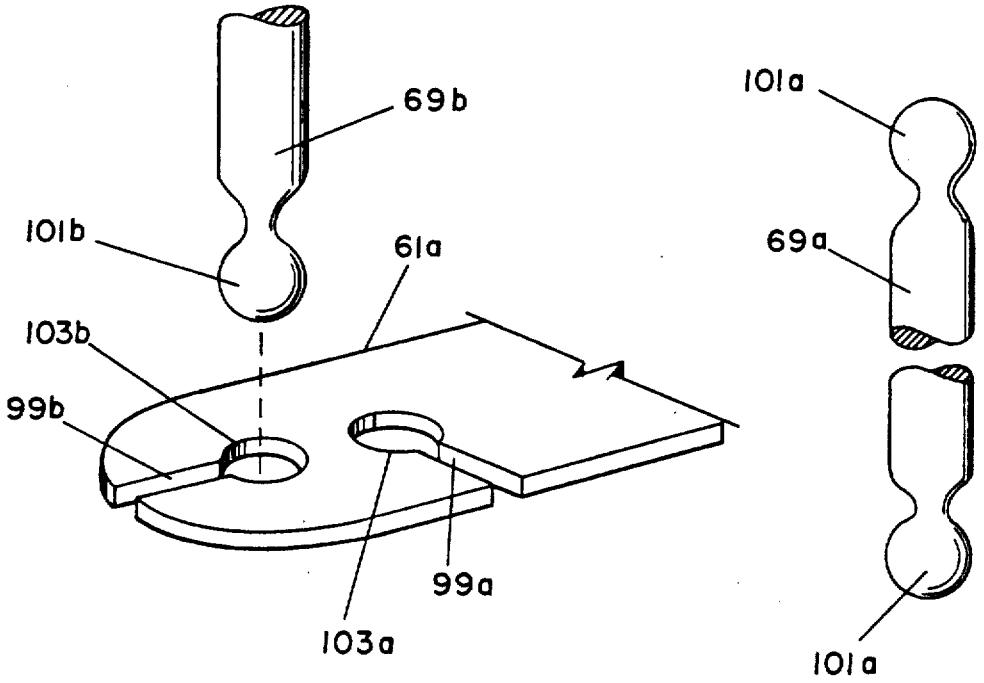
FIGS. 7A and 7B and respective views showing the manner of connecting the rods and bars of the spatial structure in accordance with an embodiment of the invention.

In FIG. 7A a bar such as 61*a* (see FIG. 5) may have two slots 99*a* and 99*b* at each of its opposite ends instead of one opening (such as opening 61*c* in FIG. 5) to receive non-co-axial rods 69*a* and 69*b* (instead of one rod such as rod 69 as shown in FIG. 5). The rods 69*a* and 69*b* may have respective bulbous end portions 101*a* and 101*b* which fit into widened portions 103*a* and 103*b* of respective slots 99*a* and 99*b*. Of course, other ways of attaching the rods to the bars will occur to those skilled in the art.

Figure 7B:
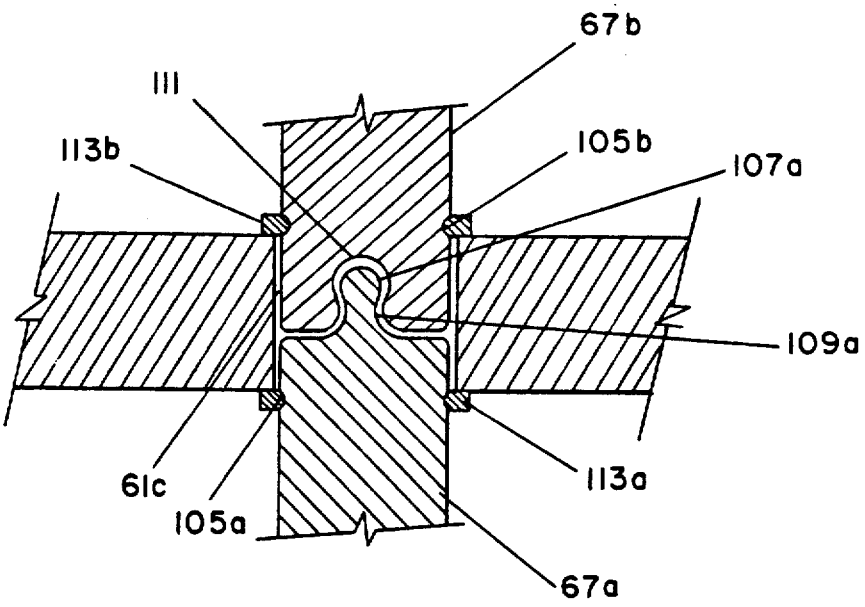

Referring to FIG. 7B, the manner of attaching central rods using a ball and socket joint of material suitable for press fit is shown where it is desired to employ several such rods rather than one rod such as rod 67 in FIG. 5. The arrangement shown in FIG. 7B is also applicable to the outer rods such as rods 69, 71, 73, and 75 in FIG. 5. In particular, two coaxial central rods 67*a* and 67*b* have near each end respective annular grooves 105*a* and 105*b*. Rod 67*a* has a ball shaped male mating end 107*a* extending from a slightly narrower neck 109*a*, and rod 67*b* has at its mating end a recessed female or socket portion 111 complementary in shape to the male end 107*a* to receive the latter as a press fit. To ensure little or no movement or slippage of the bar relative to the rod, retaining rings 113*a* and 113*b* of any suitable well known construction are located in respective grooves 105*a* and 105*b*.

Figure 8:
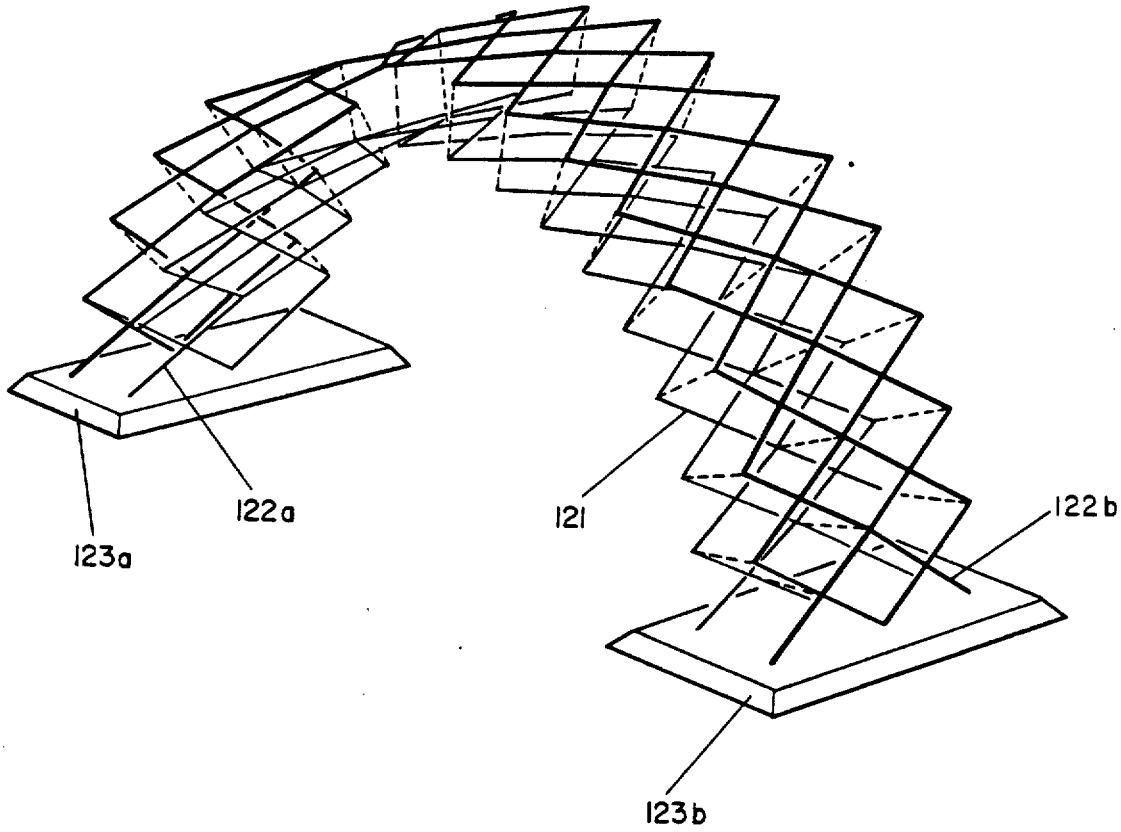
FIG. 8 depicts an open ended body in accordance with an embodiment of the invention shown extended into the shape of a curved wall or arch.

Reference is now made to FIG. 8 which shows an array of building blocks or elements such as is described in FIG. 5 arranged in the form of an arch or curved wall 121. More particularly, the arch 121 is shown in one of its expanded positions and comprises a multiplicity of rows and columns of the element portions indicated by the line B—B in FIG. 5. The respective ends 122*a* and 122*b* of the arch or curved wall are anchored by respective base plates, columns, or foundation members 123*a* and 123*b*. Alternatively, in accordance with the principles of the present invention, the ends of the arch or curved wall may be joined together forming and expandible and contractible, generally cylindrical wall essentially identical in transverse cross section (absent the actuator means) to the embodiment shown in FIG. 3.

I claim:

1. A spatial structure expandible and contractible to an infinite number of rectilinear or curvilinear positions between fully extended and fully contracted positions comprising:

(a) a first finite number of rows of expandible and contractible units thereby establishing a first row and a last row thereof;

(b) a second finite number of columns of said units thereby establishing a first column and a last column thereof;

(c) a third finite number of tiers comprising said rows and columns of interconnected expandible and contractible units;

(d) each row comprising a first multiplicity of units extending in a first direction;

(e) each unit comprising a pair of criss crossed bar means;

(f) first coupling means pivotally connecting said bar means to each other at a central portion thereof for scissors-like movement of said bar means;

(g) second coupling means pivotally connecting the end portion of each bar means of a pair thereof to one end portion of each bar means of an adjacent pair thereof in tandem to thereby provide the pivotally connected row of scissors-like units extending in said first direction;

(h) each column comprising a second multiplicity of said units extending in a second direction different from said first direction;

(i) third coupling means pivotally connecting the end portion of each bar of a pair to one end portion of each bar of an adjacent pair thereof in tandem to thereby provide the column of pivotally connected, scissors-like units extending in said second direction.

(j) a finite number of tiers, each tier comprising a third multiplicity of said units connected to each other as recited in a. and b., said finite number of tiers extending in a direction different from said first and second directions;

(k) a plurality of rod means each having first and second opposite ends, said rod means being oriented in said third direction, and (l) fourth coupling means pivotally connecting the respective opposite ends of each of said rod means to the bar means in respective adjacent tiers to thereby position each tier in spaced apart relation from each other tier in said third direction.

2. The spatial structure of claim 1 wherein said first finite number of rows is at least two, said second finite number of columns is at least two, and said third finite number of tiers is at least two.

3. The spatial structure of claim 1 wherein each of said first, second, and third finite numbers is at least three.

4. The spatial structure of claim 1 wherein all of said coupling means comprise ball and socket joints.

5. The spatial structure of claim 1 further comprising first and second support means respectively positioning the first and second ends of said rows.

6. The spatial structure of claim 5 wherein the distance between said first and second support means is less than the length of said rows, whereby the spatial structure is curvilinear.

7. The spatial structure of claim 5 wherein the first and second support means are fixed, thereby essentially constraining expansion and contraction of the spatial structure so that it becomes essentially monolithic. constraining the general shape of the spatial structure to that of essentially a cylinder.

8. The spatial structure of claim 17 further comprising motive means coupled to said structure to expand and contract the perimeter of said structure.

9. The spatial structure of claim 20 wherein the force provided is essentially analog in nature thereby enabling expansion and contraction of said perimeter as a continuous function.

10. The spatial structure of claim 17 wherein the number of rod means between each tier is approximately equal to the number of pairs of criss crossed bar means in one tier.

11. The spatial structure of claim 17 wherein the number of rod means between each tier is approximately equal to the number of first and second coupling means in one tier.

12. An endless spatial structure having an origin and a generally circular perimeter portion defining a plane and capable of being contracted and extended in a continuous manner to any perimetric position essentially in said plane including fully contracted and fully extended perimetric positions, comprising:

(a) at least first and second pluralities of tandemly coupled pairs of criss crossed structural members, each member having a central portion and opposite end portions, each pair of members being disposed along the perimeter portion and being rotatable about its central portion, the perimeter of the second plurality being radially spaced apart from and substantially greater in length than the perimeter of the first plurality when contracted or expanded, said members being oriented in other planes essentially perpendicular to said plane;

(b) first means including a plurality of angularly spaced radial rods in said plane connecting the central portion of at least two pairs of criss crossed members of the first plurality of criss crossed members to the central portion of two corresponding pairs of criss crossed members of the second plurality thereof for holding said first and second pluralities in spaced apart radial relation to each other and for pivotally coupling each pair of criss crossed members at their central portions for rotation of each said pair of members about an axis essentially in said plane, and (c) second means pivotally coupling the end portion of each member of a pair of criss crossed members to the end portion of a member of an adjacent pair of criss crossed members;

whereby upon rotation of said members about said first and second means, the lengths of the perimeters of the first and second pluralities of criss crossed members and the perimeter portion change.

13. The spatial structure of claim 12 wherein said rods are at least 3 in number spaced angularly apart from each other.

14. The spatial structure of claim 29 wherein said first means further comprises a plurality of additional rods coupling a finite number of end portions of said members of said first plurality to end portions of members of said second plurality.

15. The spatial structure of claim 12 wherein said first means includes motive means coupled to at least one of said radial rods to cause radial movement of said pluralities in said plane.

16. The spatial structure of claim 15 wherein said motive means comprises fluid handling means.

17. A spatial structure expandible and contractible in a continuous manner to any position including fully extended and fully contracted positions comprising:

(a) a first finite number of rows of expandible and contractible units thereby establishing a first row and a last row thereof;

(b) a second finite number of columns of said units thereby establishing a first column and a last column thereof;

(c) each row comprising a first multiplicity of units extending in a first direction;

(d) each unit comprising a pair of criss crossed bar means;

(e) first coupling means pivotally connecting said bar means to each other at a central portion hereof for scissors-like movement of said bar means;

(f) second coupling means pivotally connecting the end portion of each bar means of a pair thereof to one end portion of each bar means of an adjacent pair thereof in tandem to thereby provide said row of scissors-like units pivotally connected to each other to extend in said first direction;

(g) each column comprising a second multiplicity of said units extending in a second direction different from said first direction;

(h) third coupling means pivotally connecting the end portion of each bar means of a pair to one end portion of each bar means of an adjacent pair thereof in tandem to thereby provide pivotally connected scissors-like units in the column extending in said second direction;

(i) a third finite number of tiers, each tier comprising a third multiplicity of said units connected to each other as recited in a. and b., said third finite number of tiers extending in a direction different from said first and second directions;

(j) a plurality of rod means each having opposite ends, said rod means being oriented in said third direction;

(k) fourth coupling means pivotally connecting the respective opposite ends of each of said rod means to the bar means in respective adjacent tiers to thereby position each tier in spaced apart relation from each other tier in said third direction, and (l) pivot means connecting the end portions of the bars of the first and second end portions of the bar means at the first and second ends of the rows to each other, thereby constraining the spatial structure to a generally cylindrical shape.

* * * * *

UNITED STATES PATENT AND TRADEMARK OFFICE

CERTIFICATE OF CORRECTION

PATENT NO. : 5,038,532

DATED : August 13, 1991

INVENTOR(S) : Mohsen Shahinpoor

It is certified that error appears in the above-identified patent and that said Letters Patent is hereby corrected as shown below:

Column 5, line 31, equation 3:

$D_1+2S=D_2$

Column 10, line 60:

Claim 14, line 1:

change "29" to --13--

Signed and Sealed this

Sixth Day of October, 1992

*Attest:*

*Attesting Officer*

DOUGLAS B. COMER

*Acting Commissioner of Patents and Trademarks*